US005836837A

United States Patent [19]

Craig

[11] Patent Number: 5,836,837

[45] Date of Patent: Nov. 17, 1998

[54] APPARATUS FOR CIRCULAR COURT BALL GAME

[75] Inventor: Gregory Alan Craig, Rowlett, Tex.

[73] Assignee: Archworks, Inc., Dallas, Tex.

[21] Appl. No.: 792,547

[22] Filed: Nov. 6, 1996

[51] Int. Cl.[6] ..... A63B 63/08

[52] U.S. Cl. ..... 473/472; 273/394; 273/401; 473/433; 473/447; 473/479

[58] Field of Search ..... 473/431, 432, 473/433, 447, 449, 470, 472, 473, 476, 479, 480, 481, 485; 273/395, 396, 398, 401, 402, 400, 394

[56] References Cited

U.S. PATENT DOCUMENTS 3,134,594 5/1964 Crowley ..... 273/402 X
3,602,505 8/1971 Friend ..... 473/470
5,048,845 9/1991 Dunipace ..... 273/400
5,573,252 11/1996 Simmons ..... 273/396 X

*Primary Examiner*—William H. Grieb
*Attorney, Agent, or Firm*—Colin P. Cahoon

[57] ABSTRACT

An apparatus for use in a round ball rebounding game played on a circular court consisting of a spherical structure supported by a single pole and having a plurality of goals placed at equidistant intervals about the maximum horizontal diameter of the sphere and parallel to the playing surface. The apparatus further comprising a plurality of discharge tubes inserted into the bottom of the sphere, said number of tubes corresponding to the number of goals. Openings are further cut into the sphere relative to the position of each goal such that a net attached to the bottom of each goal can direct a round ball into the interior of the sphere with the ball eventually departing the bottom of the sphere through one of the discharge tubes which then deposit the ball at the base of the structure along the playing surface.

5 Claims, 3 Drawing Sheets

APPARATUS FOR CIRCULAR COURT BALL GAME

TECHNICAL FIELD OF THE INVENTION

The field of this invention relates to an apparatus for use in a round ball rebounding game played on a circular court.

BACKGROUND OF THE INVENTION

Basketball is an example of a common and popular round ball rebounding sport played both indoor and outdoor, generally with a rectangular shaped court and two goals at opposite ends of the court. A basketball goal is generally a circular hoop placed at a set height above and parallel to the playing surface. Behind the goal is a flat backstop, generally perpendicular to the goal, which acts as a rebounding surface from which the round ball can bounce back into the field of play or into the goal. Prior art variations on the basketball game generally maintain the rectangular shape of the playing surface with goals on either end and lend themselves to games played by two opposing teams.

The present invention provides for playing of a round ball game by two or more competing teams simultaneously within a circular playing area or court. This is accomplished by the use of a single structure tower topped by a dome shaped rebounding surface supporting a plurality of goals arranged at equidistant intervals around the edges of the dome. This tower structure with its circular arrangement of the goals is placed at the center of a circular playing area or court. By dividing this circular court into a number of sectors corresponding to the number of goals and assigning a sector and corresponding goal to each team, a round ball rebounding game similar to basketball can be played with a plurality of teams competing simultaneously. This game tower design allows for a fast paced and exciting variation on round ball rebounding games.

SUMMARY OF INVENTION

This invention relates to an apparatus used to play round ball rebounding-type games within a circular field of play. The invention relates to a single tower placed in the center of a circular playing surface. This tower is affixed with a sphere at the top of the tower. This sphere acts as a rebounding surface off of which round balls thrown in the direction of the sphere will bounce off of the sphere in various directions.

At or near the maximum horizontal diameter of the sphere is affixed a plurality of goals. These goals are perpendicular to the vertical axis of the tower and are placed equidistant from each other about the outside of the sphere surface. Nets hung under the goals direct any balls that are deposited in the goals through openings immediately beneath the goals into the sphere. In one preferred embodiment, the ball then rolls into one of a plurality of tubes, the number of tubes corresponding to the number of goals, which redirects the ball out of the base of the tower back onto the circular field of play.

The preferred embodiment described herein allows for simple construction of the tower apparatus using readily available commercial materials. The game itself could be played on any number of surfaces, including playground safety surfacing, asphalt, cement, sand, grass, wood, ice or water. The playing surface can be flat or might slope away from the apparatus.

By using a plurality of goals arranged in a circular court setting, this apparatus provides for the simultaneous competition of a plurality of teams. For example, each team might be assigned a sector of the circular field of play from which to begin play and a corresponding goal in which the team would attempt to deposit a ball by throwing it in the direction of the goal from any location on the circular court. It is contemplated that the use of the structure by simultaneously competing teams, the unpredictability of the rebound trajectory of balls bouncing off of the domed surface, and the unpredictable location of the ejection of balls from the base of the tower after a ball enters a goal will add to the excitement and novelty of any games designed to be played with the present invention. The circular field of play concept for which the present invention is best suited would also allow for the maximum use of limited playing area.

As shown herein, the present invention is easy to build, exciting to use, and provides limitless opportunities for the development of new and popular round ball games.

BRIEF DESCRIPTION OF THE DRAWINGS

Further objects and advantages of the present invention will become apparent from the following detailed description when read in conjunction with the accompanying drawings, in which.

DETAILED DESCRIPTION OF PREFERRED EMBODIMENT

Figure 1:
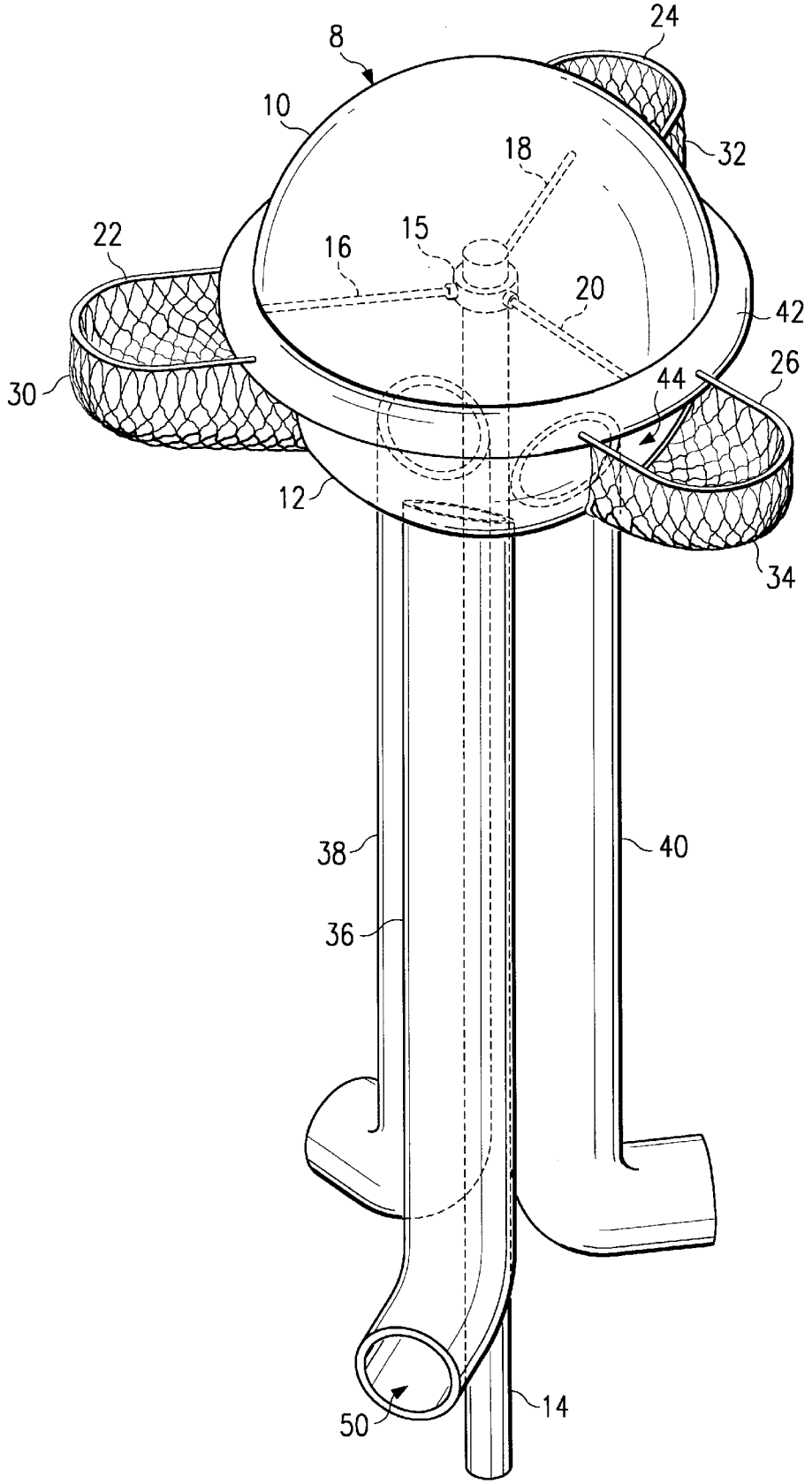
FIG. 1 is a perspective view in elevation of an embodiment of the present invention.

FIG. 1 shows a perspective view of one preferred embodiment of the present invention. FIG. 1 shows a spherical rebounding surface 8 consisting of an upper dome 10 and a lower dome 12 supported by a center pole 14. The upper dome 10 and lower dome 12 can be constructed of any suitable material, such as plastic, fiberglass, or composite materials. For ornamental purposes, a clear plastic dome, such as a forty-eight inch diameter clear polycarbonate dome distributed by Cadallic Plastics in Florida, can be used for the upper dome 10. A suitable lower dome 12 would be a polyethylene storm sewer base distributed by Advanced Drainage Systems. Rather than being separate components, the upper dome 10 and lower dome 12 could also be constructed of a single piece sphere, such as a forty-eight inch diameter, polyethylene sphere distributed by Canbar Plastics of Canada.

Figure 3:
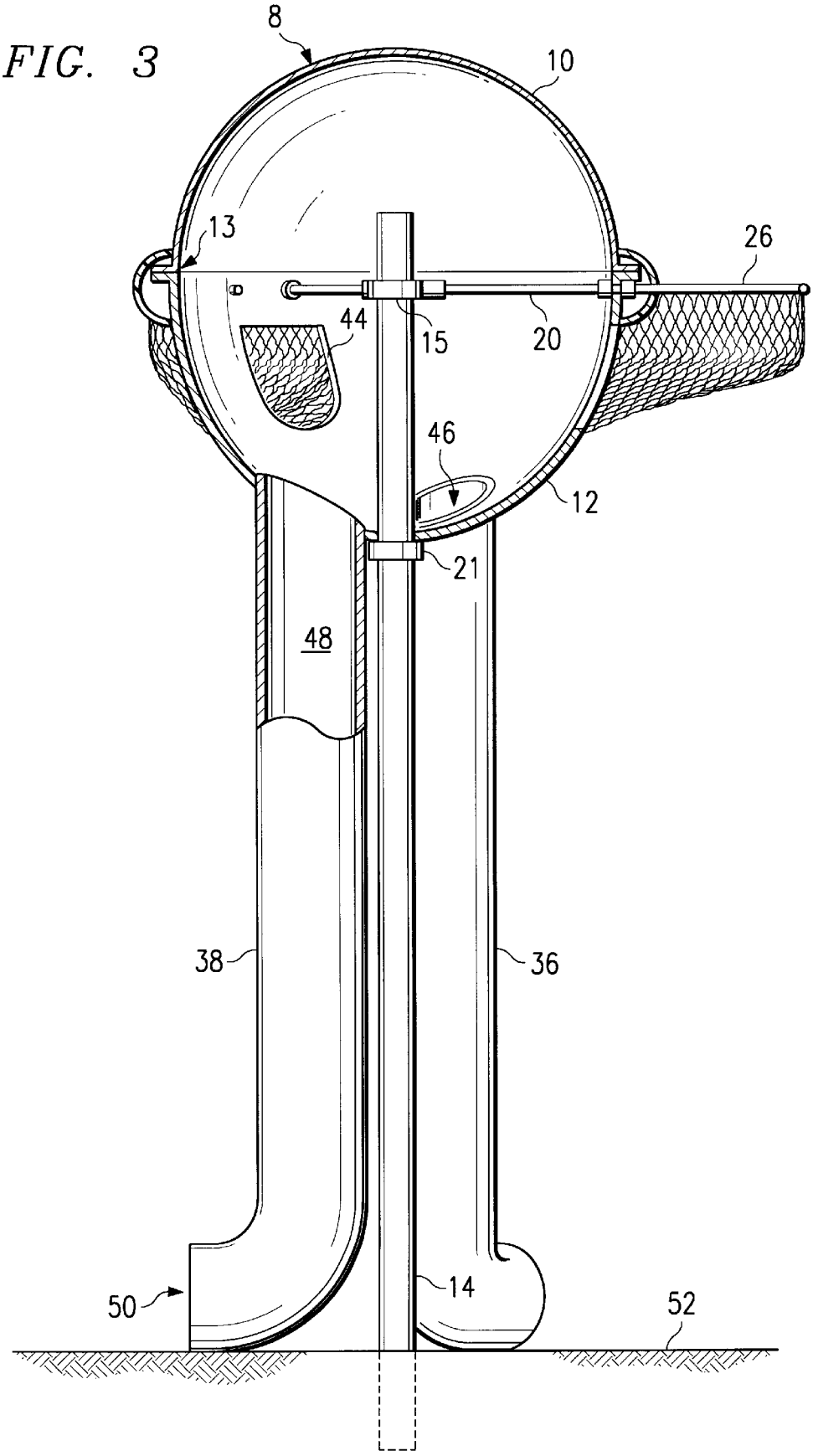

The center pole 14, typically a metal tube, extends through the base of the lower dome 12. Inside the sphere 8 a center support hub 15 is affixed over the outside diameter of the center pole 14 and attached thereto by a pin or bolt or other attaching means. Radiating at equidistance from each other in the horizontal plane from the center support hub 15 are support rods 16, 18, 20. The support rods 16, 18, 20 connect at one end to the support hub 15 and are then connected at the other end by attaching means, such as a threaded end to threaded nut combinations, to the wall of the sphere 8. These support rods, in combination with a support ring 21 shown in FIG. 3, provide the primary means to support the sphere 8 on the center pole 14.

Returning to FIG. 1, the embodiment illustrated shows three goal rims, 22, 24, 26, attached to the exterior of the sphere 8. These goal rims 22, 24, 26 can be made, for example, of metal rods or tubes fashioned in a horseshoe or "U" shape with the end of each rod or tube attached to the sphere 8 by attaching means such as threaded end to the threaded nut combinations. Attached to the bottom of and hanging from each of the goal rims 22, 24, 26 are goal nets, 30, 32, 34. These nets can be made of any suitable material, including cloth, metal chains, or synthetic materials such as two inch nylon webbing.

As can be seen by referring to the third goal rim 26 in FIG. 1, an opening 44 is cut into the lower dome 12 of the sphere 8. Similar openings are cut into the lower dome 12 relative to each other goal rim 22, 24. This opening 44 provides the means for a round ball that has been deposited into the goal rim 26 to be directed by the netting 34 through the opening 44 into the interior of sphere 8. Once the round ball enters the interior of the sphere 8, it will bounce off center pole 14 and roll around the interior of the structure until finding its way into one of the discharge tubes 36, 38, 40 which extend into the base of the lower dome 12 through openings cut into the lower dome 12 just large enough to allow for the snug insertion and attachment of the discharge tubes 36, 38, 40. The preferred embodiment illustrated shows three discharge tubes 36, 38, 40 which correspond to the three goal rims 22, 24, 26. It is anticipated that if the number of goals are changed in alternative embodiments that the number of discharge tubes will likewise be changed to correspond to a like number of goals.

A suitable material for the discharge tubes 36, 38, 40 is a corrugated polyethylene, non-perforated, flexible tubing in ten inch diameter such as distributed by Advanced Drainage Systems. The discharge tubes 36,38, 40 are attached to the center pole 14 and to the interface with lower dome 12. The discharge tubes 36, 38, 40 can be covered with foam padding or other protective materials. The interior diameter of a discharge tube 36 is large enough to allow the easy passage of a round ball used with the apparatus. Once the round ball has entered a discharge tube 36 the ball travels vertically down the interior of the tube and exits at the base of the discharge tube 36 through the discharge opening 50 at the playing surface, thus returning the ball to the field of play at a location that was unpredictable when the ball first entered a goal.

Also shown in FIG. 1 is a circumferential half-round bumper 42. This bumper 42 is located at the maximum horizontal diameter of the sphere structure 8. The bumper can be constructed of any number of materials, including plastic and rubber. This bumper 42 provides additional rebound action for balls tossed in the direction of any one of the goal rims 22, 24, 26.

Figure 2:
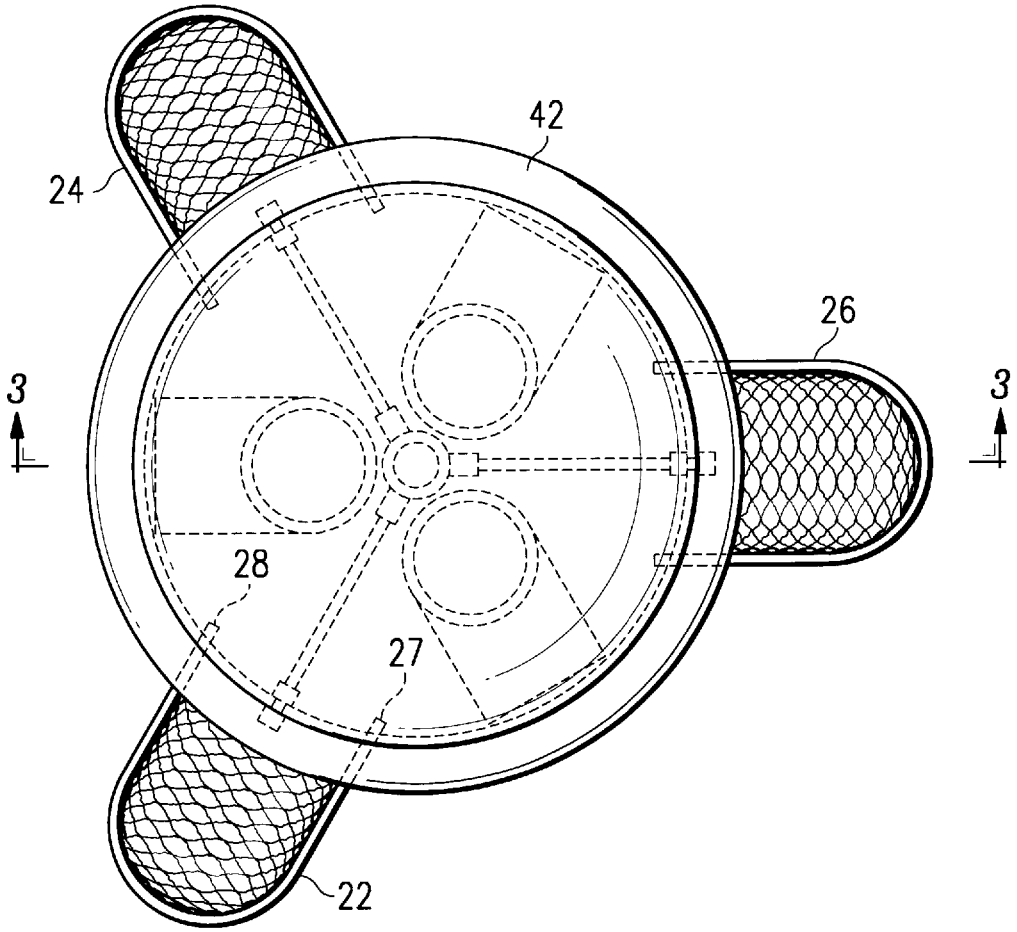
FIG. 2 is a plan view of an embodiment of the present invention; and, FIG. 3 is a fragmentary vertical cross-section in side view of an embodiment of the present invention taken substantially on a plane indicated by line 3—3 of FIG. 2.

FIG. 2 shows a plan view of the preferred embodiment of the present invention utilizing three goal rims 22, 24, 26. As previously noted, these goal rims 22, 24, 26 can be made of a metal rod or tubing fashioned in a horseshoe or "U" shape. By referring to the first goal rim 22, it can be seen that the rim has a first end 27 and a second end 28. Each end 27, 28 protrudes through the circumferentially half-round bumper 42 and attaches to the sphere 8 by an attaching means such as threading on the two ends 27, 28 with threaded nuts.

In an embodiment not shown, a support plate can be attached to the end of each support rod at the interior surface of the sphere 8. This support plate, typically made of metal, then follows the contour of the interior surface of the sphere 8 for a distance that allows for a first end 27 and a second end 28 of a goal rim to attach to the support plate. This arrangement provides positive and contiguous support for the goal rims, through the support rods 16, 18, 20 and to the center support hub 15 attached to the center pole.

FIG. 3 shows a fragmentary vertical cross section in side view, taken substantially on a plane indicated by line 3—3 of FIG. 2 of the preferred embodiment of the present invention utilizing three goal rims. This cross section illustrates that the sphere 8 consists of an upper dome 10 and a lower dome 12. The upper dome 10 and the lower dome 12 can be identical, such as perfect half spheres, or of different shape, such as a lower dome 12 with a deep basin construction as illustrated in FIG. 3. The upper dome 10 and lower dome 12 are joined at the interface 13 of said domes, thereby resulting in the sphere structure 8. This interface 13 can be made secure by any number of attaching means, including glue or epoxy, brackets, screws, or nut and bolt combinations. As noted earlier, the sphere structure 8 can also be a single piece construction as opposed to two half sphere domes connected together.

FIG. 3 further shows the center support hub 15 and the support ring 21 mounted on the center pole 14. Extending from the center support hub 15 is shown a support rod 20. This support rod 20 is shown penetrating the lower dome 12 immediately below the interface of the upper dome 10 and lower dome 12 and in the same approximate horizontal plane as the goal rim 26.

Also shown is an opening 44 through which a round ball can enter the interior of the sphere 8 after passing through a goal rim and as directed by a goal net. As noted previously, this ball would then bounce off the center pole 14 and roll into one of the openings 46 at the bottom of the lower dome 12 into one of the discharge tubes 36, 38, 40. The ball then travels down the interior of the discharge tube and exits at the discharge opening 50, thereafter rolling onto the playing surface 52. It is anticipated that the playing surface 52 could be any number of surfaces, such as playground safety surfacing, asphalt, cement, wood, grass, sand, water, or ice. While the playing surface 52 is shown as a flat surface, it might also slope away from the center pole 14.

It would be understood that various changes in the details, materials, and arrangements of the present invention which has been described and illustrated in order to explain the nature of the invention, may be made by those skilled in the art within the principle and scope of the invention as expressed in the following claims.

I claim:

1. A tower structure comprising:

(a) a center pole erected vertically;

(b) a sphere-like and hollow domed surface affixed atop said center pole (c) a plurality of openings in said domed surface;

(d) a plurality of goals attached to said domed surface with each goal placed above an opening into said surface;

(e) a plurality of tubes attached to said surface each at a corresponding opening; and, (f) a net attached to each goal to provide a channel from said goal to the opening located under each goal.

2. A tower structure on a playing surface comprising:

(a) a center pole having a first end and a second end;

(b) said first end of the center pole secured perpendicular to the playing surface;

(c) a hollow sphere-like object attached to said second end of the center pole;

(d) a plurality of goals attached to said sphere-like object;

(e) an opening through said sphere-like object under each of said goal; and (f) a net attached to each goal to provide a channel from said goal to said opening.

3. An apparatus for circular court ball game comprising:

(a) a sphere-like, hollow rebounding surface;

(b) a center pole attached to and supporting said rebounding surface;

(c) a plurality of goals attached to said rebounding surface;

(d) an opening in said rebounding surface under each of said goals; and, (e) a net attached to each goal to provide a channel from said goal to said opening.

4. The apparatus of claim 3, further comprising:

(f) a playing surface in a circular court arrangement divided into sectors corresponding to the assignment of said goals to teams using said apparatus and further divided into areas which can correspond to various game rule related positions on said playing surface.

5. The apparatus of claim 4, wherein said goals, nets, and playing surface sectors are color coded to indicate the relation of specific goals to specific playing surface sections.

* * * * *